United States Patent [19]

Bassinger

[11] 4,303,138

[45] Dec. 1, 1981

[54] EARTH DRILLING LUBRICATED HYDRAULIC SHOCK ABSORBER AND METHOD

[75] Inventor: Grey Bassinger, Midland, Tex.

[73] Assignee: Oncor Corporation, Houston, Tex.

[21] Appl. No.: 31,524

[22] Filed: Apr. 19, 1979

Related U.S. Application Data

[60] Continuation-in-part of Ser. No. 860,568, Dec. 14, 1977, Pat. No. 4,171,025, which is a division of Ser. No. 729,194, Oct. 4, 1976, Pat. No. 4,067,405.

[51] Int. Cl.[3] ..... E21B 21/00; E21B 41/00

[52] U.S. Cl. ..... 175/296; 64/23; 175/321; 277/59

[58] Field of Search ..... 175/321, 322, 107, 296, 175/297, 65, 227, 228, 229; 64/23; 277/18, 19, 59, 205; 285/299, 300; 184/5; 173/DIG. 3; 308/137

[56] References Cited

U.S. PATENT DOCUMENTS

| | | | |
|---|---|---|---|
| 2,979,350 | 4/1961 | Lansky | 277/59 X |
| 3,190,374 | 6/1965 | Caperan et al. | 175/256 X |
| 3,225,566 | 12/1965 | Leathers | 175/321 X |
| 3,866,924 | 2/1975 | French | 277/59 |
| 3,866,988 | 2/1975 | Striegler | 175/107 X |
| 4,054,040 | 10/1977 | Medders | 175/321 X |
| 4,055,107 | 10/1977 | Bartley | 277/59 X |
| 4,194,582 | 3/1980 | Ostertag | 175/227 |

*Primary Examiner*—James A. Leppink
*Assistant Examiner*—R. E. Favreau
*Attorney, Agent, or Firm*—Arnold, White & Durkee

[57] ABSTRACT

Earth drilling hydraulic shock absorber having an anvil reciprocally mounted in a casing and operatively connected with a plurality of independently operating pistons, the anvil being reciprocally mounted within the casing through a spline connection with unidirectional sealing means for equalizing pressure across the sealing means with the hydrostatic pressure in a borehole for retaining a lubricating fluid around the spline connection and to prevent abrasive matter in drilling fluid from coming in contact with the spline connection. The anvil of the shock absorber may include a reduced effective pressure area so that the anvil engages the first piston at a lower downweight.

6 Claims, 11 Drawing Figures

EARTH DRILLING LUBRICATED HYDRAULIC SHOCK ABSORBER AND METHOD

This application is a continuation in part of application Ser. No. 860,568 filed Dec. 14, 1977, now U.S. Pat. No. 4,171,025, issued Oct. 16, 1979 which is a division of application Ser. No. 729,194, filed Oct. 4, 1976, now U.S. Pat. No. 4,067,405 issued Jan. 10, 1978 which applications have the same inventive entity as this application and are all commonly assigned. U.S. Pat. Nos. 4,067,405 and 4,171,025 are incorporated herein, in toto, by this specific reference thereto, for any and all purposes.

BACKGROUND OF THE INVENTION

This invention relates generally to earth drilling hydraulic shock absorbers and more particularly to an earth drilling hydraulic shock absorber having a sealed lubricated reciprocating anvil.

U.S. Pat. No. 4,067,405 and U.S. Pat. No. 4,171,025 disclose earth drilling hydraulic shock absorbers having a reciprocating anvil 26. The anvil 26 includes a spline connection as best shown in FIG. 6 which reciprocally mounts the anvil with a casing while preventing rotation of the anvil relative to the casing. Drilling fluid flowing through the shock absorber is allowed to flow through the spline connection 28 and out the sloping crossbores 44 and through the drill bit. It has been found in practice that the abrasive materials which collect in the drilling mud tend to wear out the spline connection 28 as the tool continually reciprocates in operation. In certain formations, depending on the abrasive materials, the operating life of the shock absorber may be greatly decreased due to excessive wear on the spline connection 28.

It is thus desirable to seal the spline connection of the anvil from the drilling fluid which contains the abrasive elements to prevent the excess wear.

It would also be desirable to provide a lubricating fluid around the spline connection to further reduce wear on the splined portion. However, the earth drilling hydraulic shock absorber of the invention is typically used many thousands of feet below the surface where it encounters significant hydrostatic pressure due to the drilling fluid which is present in the borehole and within the drill string and hydraulic shock absorber. When a sealing means is provided which seals the spline connection of the anvil, pressure differentials across the seal means may quickly cause failure of the seal means as the pressure across the seal means attempts to equalize with the hydrostatic pressure in the borehole.

One means of equalizing pressure across the seal means is through the use of a moving compensator or piston which substantially mantains a lubricating fluid within the tool at the same pressure on one side of the seal means as the hydrostatic pressure of the drilling fluid in the shock absorber and borehole on the other side of the seal. While such a seal means will provide the pressure equalization, it also requires an additional moving part and may result in an increased manufacturing cost and operating cost.

An object of the invention is to provide a sealed lubricated unit which will retain the lubricating fluid within the tool and prevent exposure of the spline connection of the tool with the abrasive drilling fluid. Another subject of the invention is to equalize pressure across the sealing means as the hydrostatic pressure changes to protect the seal means from damaging differential pressures other objects of the invention will be apparent from the following specification. As far as known, heretofore no one else has achieved these results.

In certain situations, a shock absorber which utilizes the shock-absorbing effect of the plurality of pistons at lower downweights of the drill string is preferable. This allows the anvil to initially engage the first piston at lower downweights exerted on the drill bit particularly when very high pressure drilling fluid is utilized. In the example given in U.S. Pat. No. 4,067,405, approximately 18,360 lbs. of down force is required to engage the anvil with the first piston. Reducing the effective piston area of the anvil will reduce that force so that the anvil will support less weight until it engages the first piston.

An object of the invention is to accomplish this result in an economical manner, by making a shock absorber readily convertible from a high pressure tool (i.e. 18,360 lbs.) to a low pressure tool (some lesser force). This can be achieved by the invention which provides a unique contribution which can reduce inventory and manufacturing costs.

SUMMARY OF THE INVENTION

A new and improved earth drilling lubricated hydraulic shock absorber having a cylindrical casing with a generally cylindrical anvil reciprocally mounted within the casing for movement between predetermined limits is disclosed. A spline connection is provided between the reciprocating anvil and casing to allow longitudinal reciprocating movement between the casing and anvil while preventing rotation therebetween. The cross-sectional area of the casing inner surface is substantially the same at the upper portion of the anvil and the lower portion of the casing and unidirectional sealing means are provided at the upper and lower portions to obtain a lubricating fluid within the spline connection. Upper and lower unidirectional sealing means allow pressure flow in one direction to substantially equalize pressure across the upper and lower sealing means which protects the sealing means while retaining lubricating fluid around the spline connection and preventing abrasive materials in drilling fluid from getting into the spline connection as the hydrostatic pressure around the shock absorber changes.

DESCRIPTION OF THE PREFERRED EMBODIMENTS

Figure 1B:
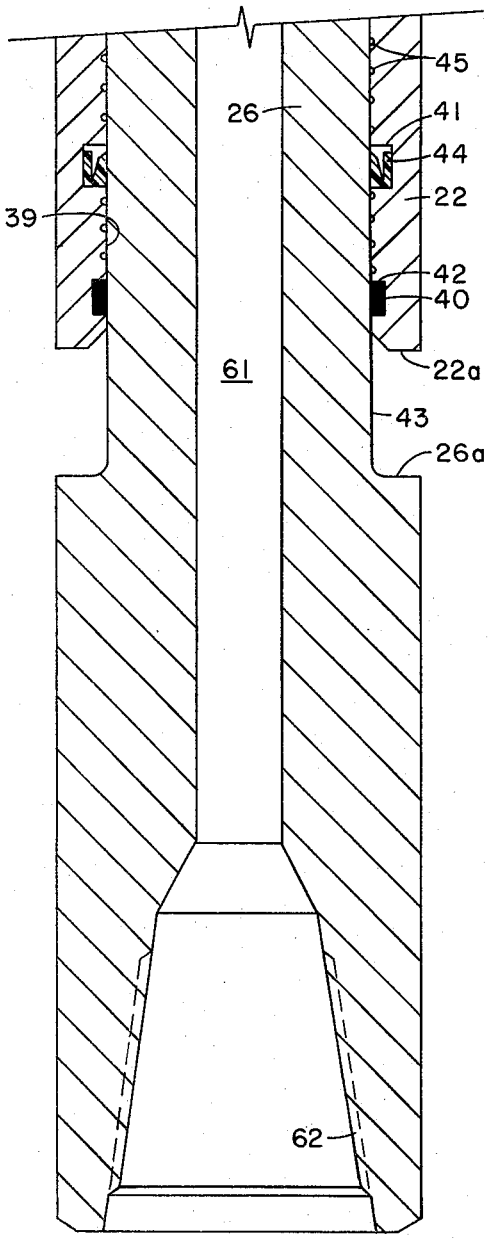
FIG. 1*b* is a cross-sectional view of the portion of the shock absorber designated 1*b* in FIG. 1.
Figure 1:
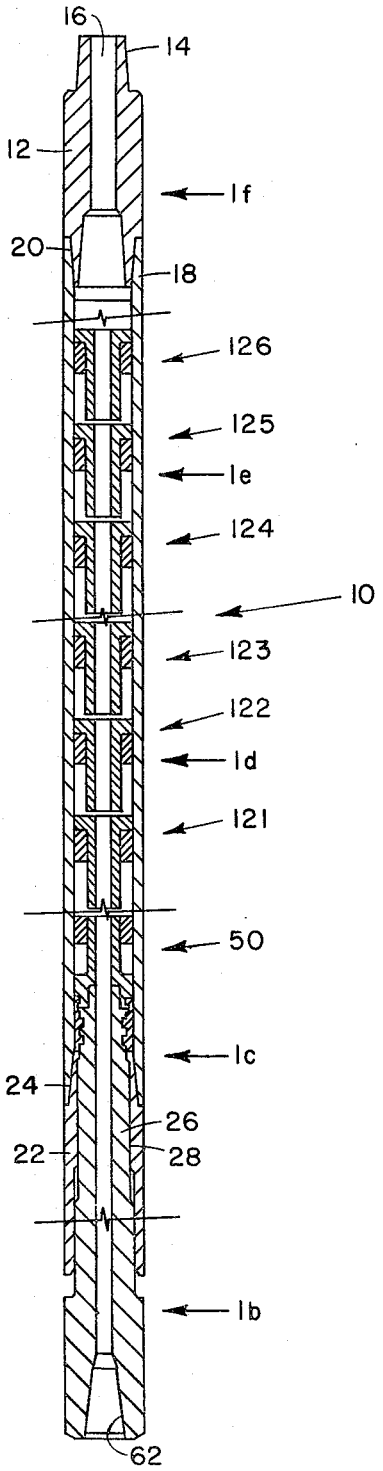
FIG. 1 is a elongated cross-section of the earth drilling lubricated hydraulic shock absorber of the invention.
Figure 1A:
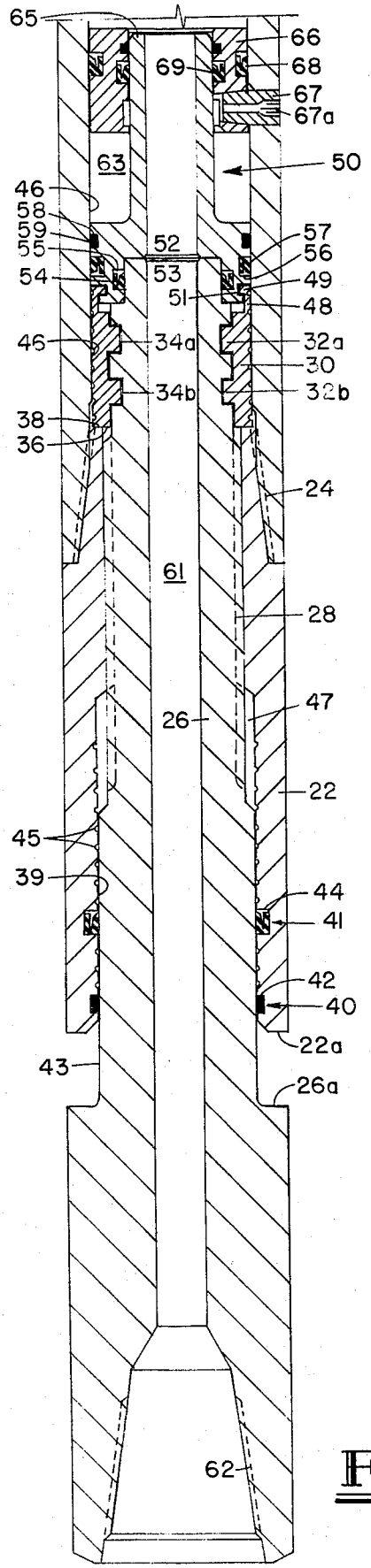
FIG. 1*a* is a cross-sectional view of the anvil and inverted piston.
Figure 1D:
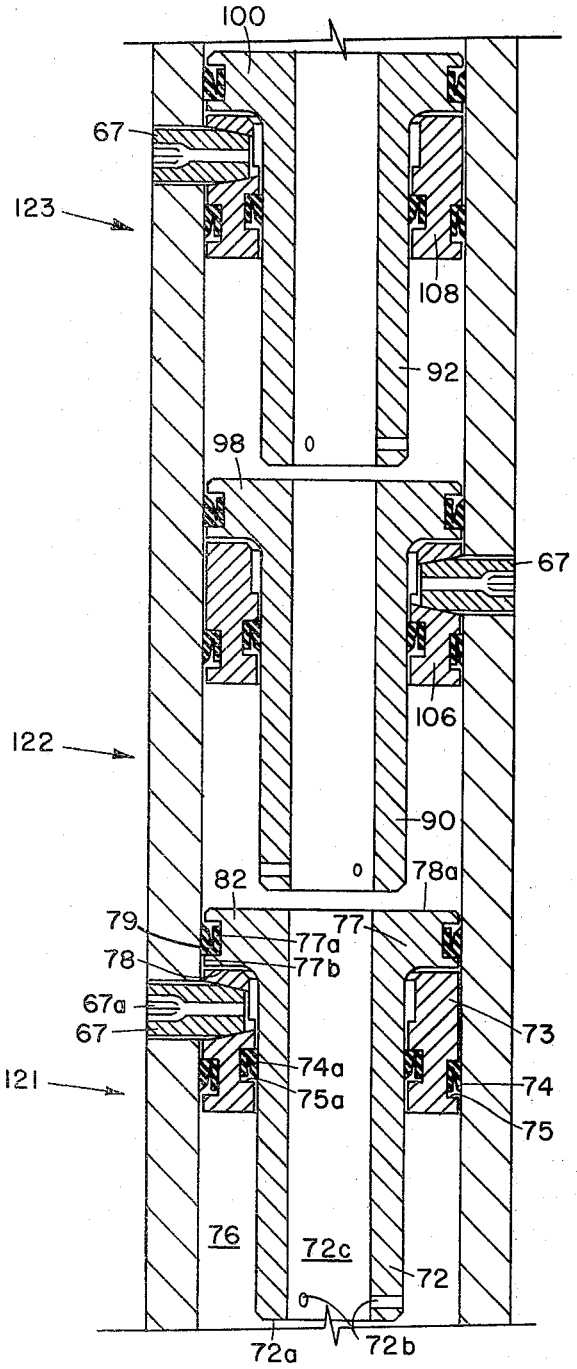
FIG. 1*d* is an cross-sectional view of the portion of the shock absorber designated 1*d* in FIG. 1.
Figure 1C:
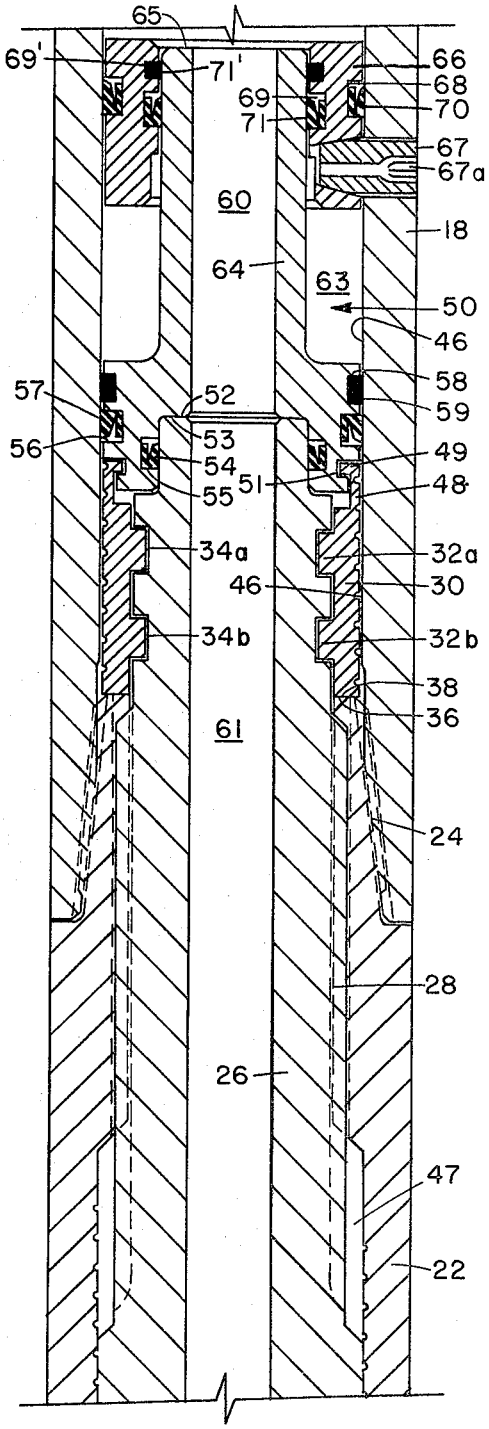
FIG. 1*c* is a cross-sectional view of the portion of the shock absorber designated 1*c* in FIG. 1.
Figure 1F:
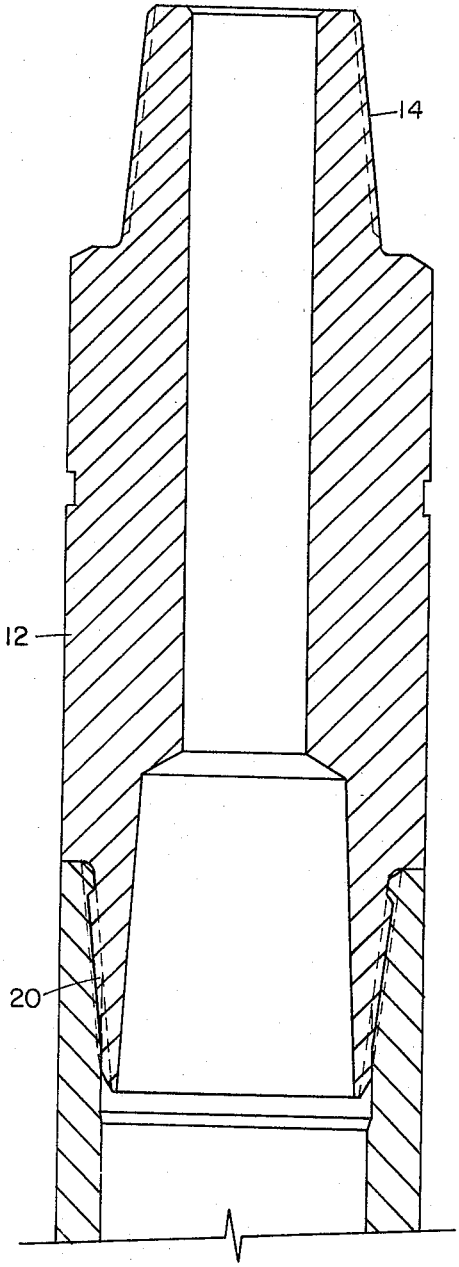
FIG. 1*f* is a cross-sectional view of the portion of the shock absorber designated 1*f* in FIG. 1.
Figure 1E:
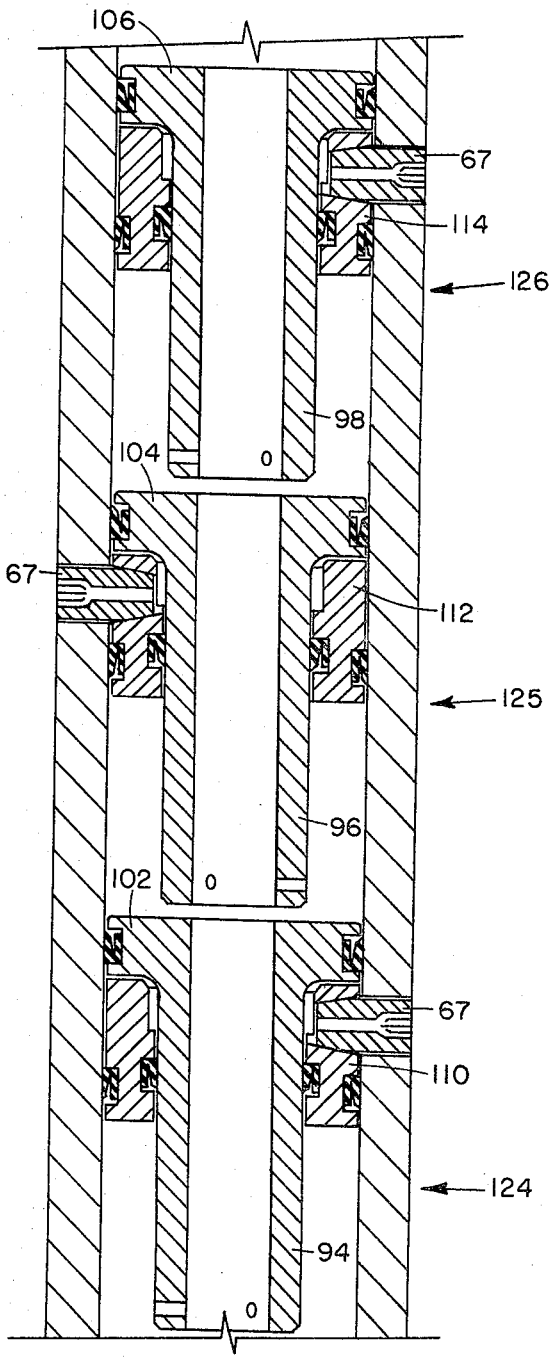
FIG. 1*e* is a cross-sectional view of the portion of the shock absorber designated 1*e* in FIG. 1.
Figure 2B:
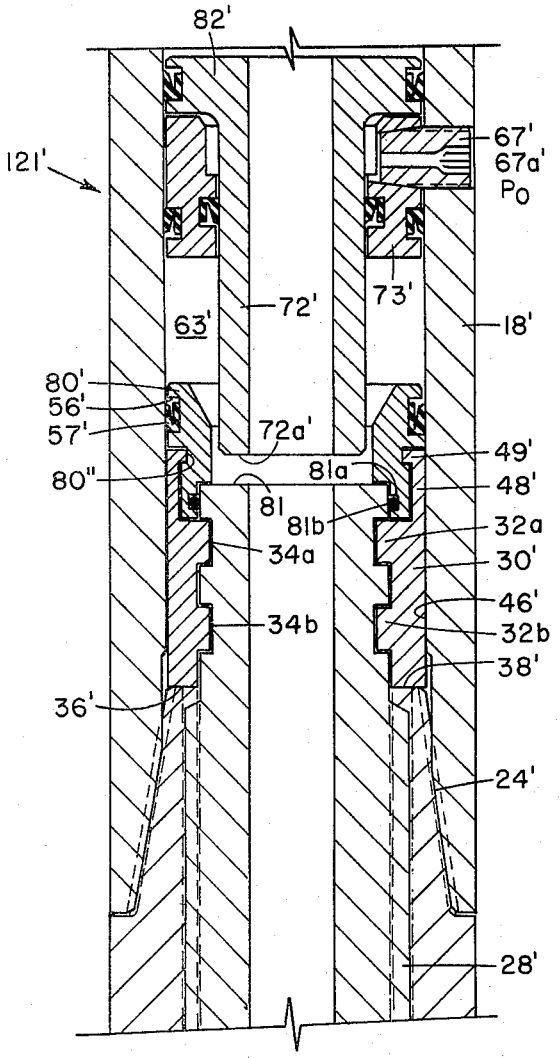
FIG. 2*b* is a cross-sectional view of the second embodiment showing the portion of the shock absorber above the portion shown in FIG. 2*a*.
Figure 2A:
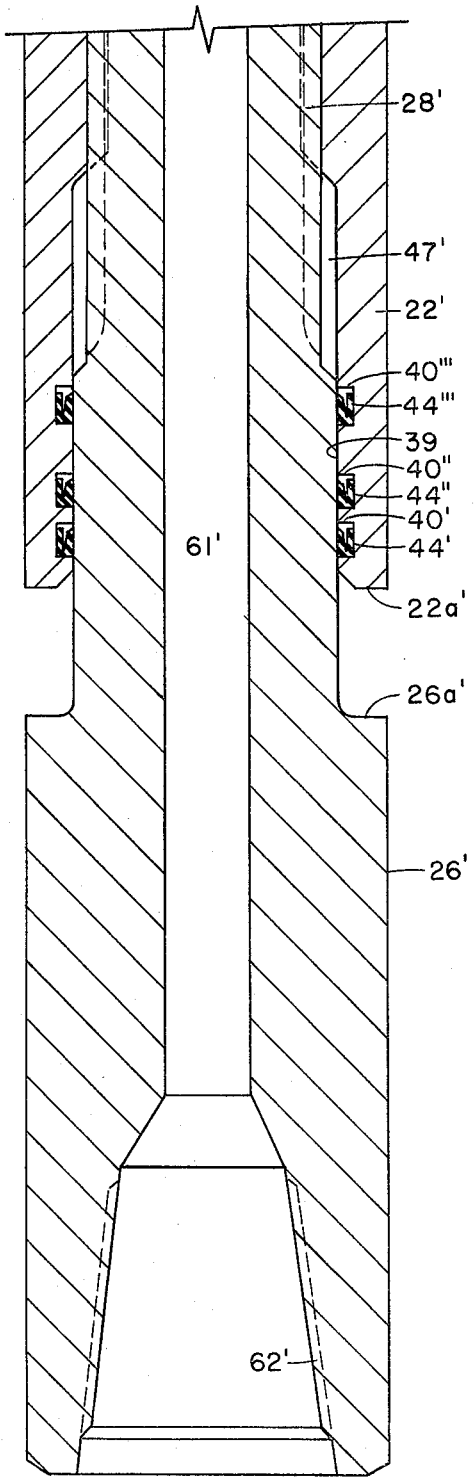
FIG. 2*a* is a cross-sectional view of a second embodiment of the shock absorber showing a lower portion of the shock absorber.
Figure 2D:
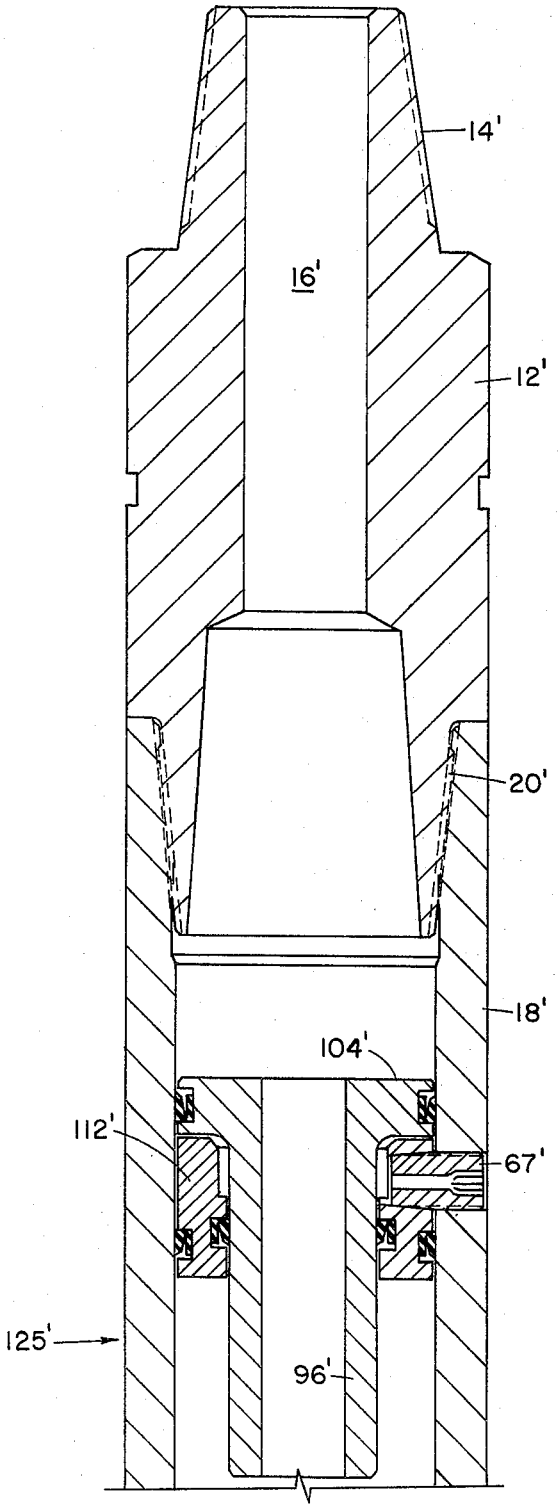
FIG. 2*d* is a cross-sectional view of the upper portion of the hydraulic shock absorber of the second embodiment which portion is immediately above the portion shown in FIG. 2*c*.
Figure 2C:
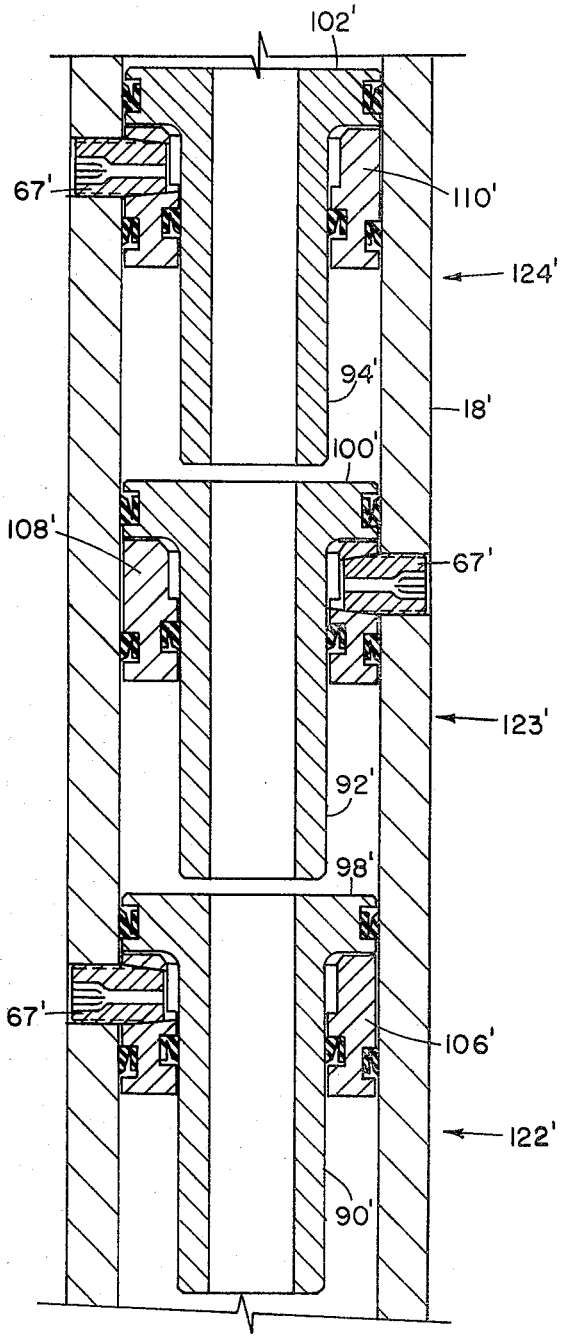
FIG. 2*c* is a cross-sectional view of a portion of the second embodiment of the shock absorber which portion is immediately above the portion shown in FIG. 2*b*.

Referring now to FIG. 1 of the drawings, there is shown the hydraulic shock absorber generally represented by the reference numeral 10. The hydraulic shock absorber 10 has an upper sub 12 for connection to a string of drilling pipe by means of threads 14. A flow passage 16 extends through the upper sub 12 for flowing drilling fluid from the string of drilling pipe which extends above the upper sub 12. The upper sub 12 is connected to a casing 18 by means of a threaded connection 20. A flow passage 60 formed by a plurality of pistons extends through casing for flowing the drilling fluid therethrough. The casing 18 includes lower sub 22 and threaded connection 24. Flow passage 61 allows flow of drilling fluid from the mud pumps through anvil 26.

Inside of lower casing 18 is mounted the anvil 26 which includes a spline connection 28 which is shown in more detail in FIG. 1(*c*). The spline connection 28 allows the anvil 26 to freely slide along the longitudinal axis of the shock absorber 10 between limit stops. The lower stop of the anvil 26 is provided by split ring 30 as best shown in FIG. 1(*c*). The split ring 30 is formed from two identical halves of a cylinder split along the longitudinal axis which halves are in abutting relationship. The split ring 30 encircles the upper portion of the anvil 26. Inwardly directed upper and lower flanges 32*a* and 32*b* respectively of split ring connection 30 are received in under cuts 34*a* and 34*b* respectively of the anvil 26. When the anvil 26 is moved downwardly inside of casing 18 to its lower most position, the bottom surface 36 of the split ring connection 30 engages and rests against the top surface 38 of the lower sub 22 which prevents further downward movement. When the anvil 26 is moved upwardly inside of casing 18 to its upper most position, the bottom surface 22*a*, FIG. 1(*b*), of the casing 18 engages and rests against the upwardly facing surface 26*a* of the anvil to prevent further upward relative movement. Reference is made to FIG. 5 of U.S. Pat. No. 4,067,405 which shows a typical spline configuration for the spline connection 28.

The inside surface 39, FIG. 1(*a*), of the lower sub 22 is machined to provide a smooth surface. Annular recesses 40 and 41 also may be machined in the inside surface. A wiper 42 may then be inserted in the recess 40. The wiper 42 is typically formed of a felt material which allows some passage of fluid while tending to screen out and to wipe abrasive particles off of the machined surface 43 of the anvil 26. Sufficient clearance is provided between the machined surface 43 and the surface 39 to allow reciprocating movement of the anvil relative to the lower sub 22 and casing 18. A unidirectional lip seal 44 is inserted in the annular recess 41 for purposes explained more fully hereinafter. A plurality of annular grooves 45 are also machined in the surface 39 which grooves collect some lubricating fluid against surface 43 to facilitate lubricating.

Referring to FIG. 1(*c*), the casing 18 includes a machined inner surface 46 such that the cross-sectional area formed by the circular surface 46 is the same of the cross-sectional area of the inside surface 39. The significance of the equality between the cross-sectional areas of surfaces 46 and 39 will be explained more fully hereinafter. An annulus 47 is formed between the outer surface of the anvil and the inner surfaces of the lower sub 22 and casing 18. This annulus is designed to hold a lubricating fluid or grease pack to provide lubrication for the splined connection 28 to reduce wear on the splines during reciprocation of the anvil during operation and to prevent drilling fluid and abrasive particles from damaging the spline connection.

The split ring connector 30 includes an extended portion 48 having a flange 49 at the upper portion thereof. An inverted piston 50 is provided at the upper end of the anvil and includes an annular groove 51 for receiving the flange 49 to secure the inverted piston to the anvil. The upper annular surface 52 of the anvil engages the lower surface 53 of the inverted piston 50 to transmit the forces which result on the anvil to the inverted piston 50. This effectively makes the pieces unitary and facilitates assembly. Also, this makes piston 50 replacable. A groove 54 is provided on the inner surface of the inverted piston 50 for receiving unidirectional lip seal 55 which seals the annulus from the high pressure drilling fluid which is pumped through the drill string. Another annular groove 56 is provided on the outer surface of the inverted piston for receiving a unidirectional lip seal 57. A third annular groove 58 is provided on the outer surface of the piston for receiving a wiper 59 which may be made of felt material. Another unidirectional seal could be used in place of wiper 59.

During operation of the shock absorber 10, drilling fluid is pumped through the flow passage 60 formed in the inverted piston 50 and flow passage 61 formed in the anvil 26. A suitable drill bit is connected to a threaded connection 62, FIG. 1(*b*), for drilling. The drilling fluid, in addition to the liquids, contains some abrasive drill cuttings and also contains suspended particles which give it the desired density to prevent blow-outs and also to flush cuttings out of the bore hole. These materials in the fluid may be very abrasive to the spline connection 28. Fluid having hydrostatic pressure, the pressure depending on the depth of the borehole, is allowed to pass into the annulus chamber 63 to contact the wiper 59 and seal 57. The unidirectional lip seal 57 may allow a small amount of the pressure to seep thereby to equalize pressure across the seal 57. Referring to FIG. 1(*a*), fluid under the hydrostatic pressure is also allowed to contact the felt wiper 42 and the unidirectional seal 44 to equalize pressure across the seal. Accordingly, the pressure inside the chamber or annulus 47 which contains the lubricating fluid, is maintained at substantially the same pressure as hydrostatic pressure in the borehole so as to prevent a pressure differential there between. Since the cross-sectional area of the seal diameter at the upper unidirectional seal 57 is the same as at the lower unidirectional seal 44, the tendency for the fluid inside the annulus 47 to surge is eliminated. Also, since the unidirectional seals allow fluid pressure equalization, the pressure across the unidirectional seals 57 and 44 are substantially equalized so there is much less tendency to extrude the seal or otherwise cause failure. Seals 57 and 44 can become working seals if seal 54 fails. The annulus 47 is packed as tight as possible with suitable lubricating fluids such as grease to prevent drilling mud from getting inside the annulus where it could damage the spline connection 28. The unidirectional seal 54 does not allow passage of fluid from the flow passages 60 and 61 to pass into the annulus 47 but does allow pressure inside the annulus 47 to equalize with that outside the annulus when the hydrostatic pressure is reduced such as when the shock absorber is raised out of a borehole. The life of the spline connection 20 and 28 is greatly prolonged since the lubricating pack is retained therein by the seals, and the pressure equalization greatly extends the life of the seals.

The inverted piston 50 includes an annular sleeve portion 64 which has a circular pressure area 65 at the upper end thereof which includes the cross sectional area of flow passage 60. The annular pressure area 65 is the effective area against which drilling fluid passing through the shock absorber 10 acts downwardly to extend the anvil 26 relative to the casing 18. Seating ring 66 is held in position by a plurality of hollow screws 67 (one of which is shown). The seating ring 66 includes an outer annular groove 68 and an inner annular groove 69 in which are mounted unidirectional lip seals 70 and 71, FIG. 1(*c*) respectively. An annular groove 69' may be provided for a wiper 71'. Fluid passing through the passageway in the shock absorber 10 is prevented from flowing directly into the annulus 63 by the unidirectional seals 70 and 71. Fluid which collects in the chamber or annulus 63 is allowed to flow through the passageway or orifice 67*a* extending through the hollow screws 67. The passageway 67*a* is sized to provide a dampening effect as drilling fluid is forced therethrough during reciprocation. Inside the casing 18 are located a plurality of hollow pistons, designated as first stage piston 121, second stage piston 122, third stage piston 123, fourth stage piston 124, fifth stage piston 125 and sixth stage piston 126. The pistons have similar components consisting of flanges respectively designated as 82, 98, 100, 102, 104 and 106. The pistons also have downwardly extending sleeves respectively designated as 72, 90, 92, 94, 96 and 98. The sleeves are slidably received in seating rings designated as 73, 106, 108, 110, 112 and 114 which are each connected to the casing by means of a plurality of hollow screws 67 (one of which is shown) communicating drilling fluid through the casing 18 between each piston and flange. Referring to FIG. 1(*d*), a detailed description of the piston and seating rings will be given only for the first stage piston 121. The arrangement and function of each piston stage is identical. It is also to be noted that in the preferred embodiment, the casing is described as a unitary member, however, it may be constructed in segments, each segment housing a single piston with a seating ring forming an integral part of the casing segment.

Seating ring 73 is held in position by hollow screws 67 (one of which is shown) above anvil 26. The seating ring 73 seals the casing 18 by means of a unidirectional lip seal 74 which is fitted in annular groove 75. Due to the hydrostatic balance a bidirectional seal might also be used. Each screw 67 has a passageway or orifice 67*a* communicating from outside the casing 18, to a chamber annulus 79 formed between the seating ring 73 and sleeve 72 of the first stage piston 121. The passageways or orifice 67 are predetermined to provide a desired snubbing action. The sleeve 72 is slidably received inside of the seating ring 73. Sleeve 72 is sealed with the seating ring 73 by means of a seal 74*a* which is inserted in an annular groove 75*a* in the seating ring 73. At the lower portion of the sleeve 72 adjacent to lower surface 72*a*, a plurality of cross slots or passages, 72*b*, preferably three spaced at 120 degrees, are provided to allow pressurized fluid flow from drilling pumps through sleeve flow passage 72*c* to allow fluid to pass in and out of the chamber or annulus 76 when the piston is in motion.

The first piston stage 121 has a radially extending flange 77 that slidably seals with casing 18 by means of a unidirectional lip seal 77*a* which is fitted in annular groove 77*b* in the radially extending flange 77. Again due to the hydrostatic balance, a bidirectional might be used. As can be seen from the drawings, the surface area 78 formed by the bottom surface of the radially extending flange 77 is acted on by the pressurized fluid outside of the casing 18 which flows into chamber or annulus 79 through passage 67*a*. The pressure inside the flow passage 72*c* is acting on the upper surface area 78*a* and bottom surface 72*a* of the piston 72. The pressure outside the casing 18 is acting on the surface area 78. In operation the pressure, discounting cancelling hydrostatic pressure outside the shock absorber is substantially less than the pressure inside by an amount substantially equal to the pressure drop (differential pressure) across the drill bit (not shown). The downward pressure acting on the piston 72 is the differential pressure. The pressurized fluid which results in the differential pressure is provided by the mud pumps to flow the drilling fluid through the drill string.

Referring now to FIGS. 2(*a*), 2(*b*), 2(*c*) and 2(*d*), there is shown a second embodiment of the hydraulic shock absorber generally represented by the number 10 in FIG. 1. Numerous components of the shock absorber shown in the embodiment in FIGS. 2(*a*)–2(*d*) are identical to those of the shock absorber shown in FIGS. 1(*a*)–1(*f*) so the same reference numerals are used with the addition of a prime sign to distinguish them. The hydraulic shock absorber shown in FIGS. 2(*a*)–2(*d*) has an upper sub 12' for connection in a string of drilling pipe by means of threaded connection 14'. A center flow passage 16' extends through the upper sub 12' for receiving drilling fluid from the string of drilling pipe. The upper sub 12' is connected to a casing 18' by means of threaded connection 20'. A lower sub 22' is connected to the bottom of casing 18' by means of threaded connection 24'.

Inside of lower sub 22' is mounted an anvil 26' by means of a spline connection 28' which is the same as spline connection 28. By means of spline connection 28', the anvil 26' is free to slide along the longitudinal axis of the hydraulic shock absorber between limit stops. The lower stop of the anvil 26'is controlled by split ring 30'. The split ring 30' is formed from two identical halves of a cylinder split along the longitudinal axis which halves are in a butting relationship. The split ring 30' encircles the upper portion of anvil 26'. Inwardly directed upper flange 32*a* and lower flange 32*b* of split ring connection 30' are received in upper undercut 34*a* and lower undercut 34*b* respectively of anvil 26'. Movement of anvil 26' downwardly inside of lower sub 22' to its lowermost position, engages the bottom surface 36' of the split ring connection 30' against the top surface 38' of the lower sub 22' which prevents further downward movement of the anvil 26' relative to the casing 18'. Upward movement of the anvil 26' is limited by the upper stop formed from an abuttment of shoulder 26*a'* with the bottom surface 22*a'* of the lower sub 22'. The anvil 26' is normally connected to a drill bit (not shown) by means of threaded connection 62'. The inside surface 39' of the lower sub 22' is machined to provide a smooth surface. One or more annular recesses 40', 40'' and 40''' are provided in the lower sub 22' by receiving a plurality of unidirectional lip seals 44', 44'', and 44''' respectively. The unidirectional lip seals allow pressure equalization fluid in one direction only which in this case would be into the annulus 47' formed between the anvil 26' and lower sub 22'. The split ring 30' includes an extended portion 48' having an inwardly directed flange 49'. A seal retainer 80' includes an annular recess 80'' which receives the flange 49' to rigidly secure the seal retainer 80' with the split ring 30'. As will be apparent, the purpose of the split ring 30' is to facilitate assembly of the seal retainer 80' with the anvil 26'. The seal retainer 80' includes an annular groove 56' which receives a unidirectional lip seal 57' which functions similarly to the unidirectional lip seal 54 as shown in FIG. 1(*c*) to block the high pressure drilling fluid from annulus, 47. Namely the unidirectional lip seal 57' will prevent flow of pressurized fluid into the chamber annulus 47'. O-ring seal 81*a* which is a bidirectional seal is provided in groove 81*b* to also seal the annulus 47' from the differential pressure. A lubricating fluid or grease pack is packed as tight as possible in the chamber annulus 47' to prevent drilling fluid from getting inside the chamber or annulus 47' and damaging the spline connection 28'.

The anvil 26' functions similarly to the anvil shown in U.S. Pat. No. 4,067,405 in that no reduced effective pressure area is provided. The upper surface area 81 of the anvil directly only engages the lower surface area 72*a''* piston 72' at a relatively high downweight depending on the differential pressure. This is provided by the increased surface area upon which the differential pressure is acting. Accordingly, at higher downweights and lower differential pressures, the tool may be effectively utilized.

Inside the casing 18' are located a plurality of hollow pistons, designated as first stage 121', second stage 122', third stage 123', fourth stage 124' and fifth stage 125'. The pistons have similar components consisting of flanges respectively designated 82', 98', 100', 102' and 104'. The flanges also have downwardly extending sleeve portions respectively designated as 72', 90', 92', 94' and 96'. The sleeves are slidably received in seating rings designated respectively as 73', 106', 108', 110' and 112' which are connected to the casing by means of hollow screws with metered orifices 67' having specific diameter passageways 67*a'* communicating through the casing 18'. The operation of the stages 121' through 125' is substantially identical to the operation of the stages 121 through 125 in FIGS. 1—1(*f*). The passageways or orifices 67*a'* are predetermined to provide a desired snubbing action. Accordingly, no further description is given of this operation. Also, the detailed components of the first stage 121' are the same as the above described components of first stage 121 of the above described embodiment so no further description is given.

An inverted piston (not shown) may be provided in place of the seal retainer 80'. This would eliminate the first stage piston 121' as the inverted piston 50 does in the embodiment of FIG. 1. The same connection for the seal retainer 80' to the split ring 30' could be used for an inverted piston for the first stage of the embodiment of FIGS. 2*a*–2*d*. Accordingly, the embodiment of FIGS. 2*a*–2*d* could serve as both a low and high pressure shock absorber as required by the drilling conditions.

METHOD OF OPERATION

Referring now to FIG. 1(*a*) of the drawings, the hydraulic shock absorber 10 briefly described in conjunction with FIG. 1, is shown with the anvil 26 in the fully extended position with the bottom 36 of the split ring connection 30 resting against the top 38 of the lower sub 22. The maximum distance is separating shoulder 26*a* from bottom 22*a* of lower sub 22. The upper surface 65 of the inverted piston 50 is not engaged with the piston 72 of the first stage piston 121.

As a typical illustration concerning the use of the hydraulic shock aborber 10, assume that the pressure drop across the drill bit is approximately 2000 P.S.I. If the effective area of the anvil 26 as defined by the surface area 65 is approximately 5.4 sq. in., the downward force caused by the pressure drop is equal to 2000 P.S.I. times 5.4 sq. in., or approximately 10,800 pounds of force acting against anvil 26 to move the anvil 26 to an extended position. Therefore, during normal drilling operations a total of 10800 pounds of downweight must be exerted on the drill bit to overcome the downward force of the drilling fluid on the anvil 26 which extends the anvil. Once the downweight exceeds 10800 pounds, the anvil 26 will slide upwardly until it abuts the bottom 72*a* of first stage piston 121.

The operation of the piston stages is the same as that described in U.S. Pat. No. 4,067,405 with the amount of downweight required to serially engage the pistons depending upon the effective surface area of the piston and pressure differential.

During drilling operations, the dynamic force of the drill string will result in the anvil 26 reciprocating back and forth. As explained above, fluid under a hydrostatic pressure depending on the depth of the boreholes is present outside the casing 18 which acts on the unidirectional lip seals 41 and 57. However, the annular space 47 is tightly packed with lubricating fluid or grease which prevents entry of the fluids along with abrasive materials into the annulus or chamber 47. The unidirectional lip seals will allow pressure equalization across the seals so that the pressure in the annulus of chamber 47 is equal to the pressure outside the casing. This acts to prevent washing out of the seals 44 and 57 as the hydrostatic pressure changes. A bidirectional seal which seals in both directions will not allow pressure equalization of the chamber annulus 47 with the hydrostatic pressure outside the drill string. This can quickly cause washing out or damage to the seals and loss of lubricating fluid as the hydrostatic pressure changes such as when the drill string is lowered or raised in the borehole. Loss of the lubricating fluid results in early failure of the tool since abrasive materials in the drilling fluid can quickly wear away the spline connection.

The seals are preferably made of a material which is resistant to high temperatures and which can sustain wear due to reciprocation of the anvil 26. The operating life of the shock absorber is dependent on the drilling conditions such as pressure and temperature as well as the abrasive materials which are present for drill cuttings and the drilling fluid.

The embodiment shown in FIGS. 2*a*–2*d* functions similar except that the seals 44', 44'' and 44''' allow hydrostatic pressure equilization (increasing pressure) as the drill string is lowered in the borehole. The seal 57' allows hydrostatic pressure equilization (decreasing pressure) as the drill string is raised from the borehole.

It is understood that though I have illustrated and described certain forms of my invention, my invention is not limited to those specific forms herein described and shown.

I claim:

1. A shock absorber having a sealed lubricated reciprocating anvil for use with an earth boring drill string utilizing drilling fluid, comprising:

a casing defining an inner surface and for connecting with a drill string;

an anvil having a pressure responsive surface for transferring the force of the drilling fluid to the anvil and defining an outer surface reciprocally mounted within the casing inner surface and forming an annulus with the casing inner surface and having a lubricating fluid in the annulus;

said anvil having an inverted piston means having a pressure responsive surface smaller than the pressure responsive surface of the anvil and blocking any force of the drilling fluid from acting on the larger pressure responsive surface of the anvil to provide a lower drilling fluid pressure responsive shock absorber; and said casing inner surface and said anvil outer surface having unidirectional upper and lower sealing means at opposed ends of the annulus to retain the lubricating fluid therein and prevent abrasive matter from getting into the annulus while equalizing pressure across the sealing means.

2. The shock absorber as set forth in claim 1, wherein:

the cross-sectional area of the casing inner surface is the same at the upper and lower sealing means to prevent damage to the unidirectional seal means and loss of the lubricating fluid from the annulus.

3. The shock absorber as set forth in claim 1, wherein:.

the casing and anvil have spline connection to prevent relative rotation therebetween.

4. The shock absorber as set forth in claim 1, 2 or 3 wherein:

the sealing means include wiper means to prevent particulate matter from entering the annulus.

5. The shock absorber as set forth in claims 1, 2 or 3 wherein:

the upper and lower sealing means allow pressure flow in opposite directions to provide pressure equalization across the upper and lower sealing means to avoid a pressure differential across the upper and lower sealing means and loss of lubricating fluid from the annulus as the hydrostatic pressure changes.

6. The shock absorber as set forth in claim 1, wherein:

the inverted piston is removably secured with the anvil.

* * * * *